US010010901B2

(12) United States Patent
Ikushima

(10) Patent No.: US 10,010,901 B2
(45) Date of Patent: Jul. 3, 2018

(54) CLEANING DEVICE AND CLEANING METHOD FOR LIQUID MATERIAL DISCHARGE DEVICE

(71) Applicant: MUSASHI ENGINEERING, INC., Mitaka-shi, Tokyo (JP)

(72) Inventor: Kazumasa Ikushima, Mitaka (JP)

(73) Assignee: MUSASHI ENGINEERING, INC., Tokyo (JP)

( * ) Notice: Subject to any disclaimer, the term of this patent is extended or adjusted under 35 U.S.C. 154(b) by 499 days.

(21) Appl. No.: 14/409,829

(22) PCT Filed: Jun. 18, 2013

(86) PCT No.: PCT/JP2013/066642
§ 371 (c)(1),
(2) Date: Dec. 19, 2014

(87) PCT Pub. No.: WO2013/191151
PCT Pub. Date: Dec. 27, 2013

(65) Prior Publication Data

US 2015/0182981 A1 Jul. 2, 2015

(30) Foreign Application Priority Data

Jun. 19, 2012 (JP) ..... 2012-138150

(51) Int. Cl.
*B08B 9/00* (2006.01)
*B05B 15/55* (2018.01)
(Continued)

(52) U.S. Cl.
CPC ..... *B05B 15/557* (2018.02); *B05B 15/55* (2018.02); *B05C 5/0233* (2013.01); *B08B 9/0328* (2013.01); *B05B 1/3046* (2013.01)

(58) Field of Classification Search
CPC . B05B 15/025; B05B 15/0266; B05B 1/3046; B08B 9/0328; B05C 5/0233
See application file for complete search history.

(56) References Cited

U.S. PATENT DOCUMENTS 2,919,704 A 1/1960 Butler
3,572,650 A * 3/1971 Kupka ..... A47J 43/085 366/284

(Continued)

FOREIGN PATENT DOCUMENTS

EP 0 588 054 A1 3/1994
EP 0588054 A1 * 3/1994 ..... A43D 25/183

(Continued)

OTHER PUBLICATIONS

Scott, Pressure Regulators: Definitions and Descriptions—Products & Services, Feb. 1, 2002, Scott, date stamp, 3 sentences of a two stage regulator.*

(Continued)

*Primary Examiner* — Binh X Tran
*Assistant Examiner* — David Cathey, Jr.
(74) *Attorney, Agent, or Firm* — Westerman, Hattori, Daniels & Adrian, LLP

(57) ABSTRACT

A cleaning device for cleaning a liquid contact part of a discharge device, the liquid contact part including an operating space in which a rod-like member is operated, and a supply flow path, the cleaning device including a compressed gas source, a cleaning fluid supply tank, a plurality of supply mechanisms that supply compressed gas and a cleaning fluid, a cleaning fluid collection tank, a liquid contact part fixing jig to which the plural supply mechanisms and the cleaning fluid collection tank are fluidly connected, and which accommodates the liquid contact part of the discharge device, and a control device, wherein the cleaning fluid is supplied to the liquid contact part fixing jig (Continued)

in accordance with pressure values, which are specified separately for the plural supply mechanisms, by the control device. The liquid contact part can be cleaned with a uniform flow without disassembling the liquid contact part.

20 Claims, 6 Drawing Sheets

(51) Int. Cl.

| | |
|---|---|
| ***B05C 5/02*** | (2006.01) |
| ***B08B 9/032*** | (2006.01) |
| *B05B 1/30* | (2006.01) |

(56) References Cited

U.S. PATENT DOCUMENTS

| | | | |
|---|---|---|---|
| 4,025,363 | A | 5/1977 | De Santis |
| 2,726,667 | A | 12/1995 | Wigmore |

FOREIGN PATENT DOCUMENTS

| | | | |
|---|---|---|---|
| JP | 03-169364 | A | 7/1991 |
| JP | 5-76563 | U | 10/1993 |
| JP | H06-198229 | A | 7/1994 |
| JP | H08-142314 | A | 6/1996 |
| JP | 2005-058946 | A | 3/2005 |
| JP | 2007-253093 | A | 10/2007 |
| JP | 2009-045530 | A | 3/2009 |
| TW | I343283 | B | 6/2011 |

OTHER PUBLICATIONS

Espacenet, translaton of EP0588054, Mar. 9, 2017, EPO, 5 pages.*
Chaudhary, What is the difference between bar, rod and beam?, Apr. 24, 2017, Jira, one page.*
Office Action dated Aug. 1, 2016, issued in counterpart Taiwanese Patent Application No. 102121729. (9 pages).
Search Report dated Aug. 2, 2016, issued in countepart Taiwanese Patent Application No. 102121729, with English translation. (2 pages).
International Search Report dated Sep. 17, 2013, issued in corresponding Application No. PCT/JP2013/066642 (2 pages).
Supplementary European Search Report dated Jan. 22, 2016, issued in European Application No. 13 80 7310 (2 pages).
Office Action dated Jun. 28, 2016, issued in counterpart Japanese Application No. 2012-138150, with English translation. (6 pages).

* cited by examiner

CLEANING DEVICE AND CLEANING METHOD FOR LIQUID MATERIAL DISCHARGE DEVICE

TECHNICAL FIELD

The present invention relates to a cleaning device and a cleaning method for cleaning an inner flow path of a liquid contact part of a discharge device that discharges a liquid material from a nozzle by the action of a mechanically-operated rod-like member. The term "liquid contact part" used in this Description implies one or a plurality of members in which an operating space where the rod-like member is operated and a flow path in contact with the liquid material (e.g., a flow path extending from a liquid material reservoir to a nozzle) are formed.

BACKGROUND ART

In a liquid material discharge device, there is a possibility that the viscosity of a liquid material may increase with the lapse of time, and that clogging may occur in a flow path or a nozzle inside a device body, or a discharge amount may change (mainly reduce). It is hence required to periodically clean the flow path in contact with the liquid material. The cleaning is essential particularly in a discharge device (see FIGS. 4 to 6) of type discharging the liquid material from a nozzle by the action of a mechanically-operated rod-like member because that type of discharge device generally has a complicated structure.

The discharge device is generally cleaned by a method of disassembling the discharge device into individual components, dipping each component, to which the liquid material adheres, in a solvent (cleaning fluid) prepared in a vessel of a relatively small volume, and cleaning the component with an ultrasonic cleaner. Such a method can be readily practiced without needing large-scaled equipment, but it has the following problems.

The first problem is concerned with time. Disassembling and assembling the discharge device take a time. The liquid material cannot be removed unless ultrasonic vibration is applied for a comparatively long time. In order to fully remove the liquid material, the cleaning has to be carried out several times while the solvent is replaced with fresh one. The second problem is concerned with effect of the cleaning. The liquid material having dissolved into the solvent may adhere to the component again. In other words, the liquid material may be not fully removed. The third problem is concerned with safety. Because the cleaning is basically performed manually, there is a risk that harmful substances (including the solvent and the liquid material) may contact the operator's body.

Another method is also known in which pipes are connected to the body and the nozzle of the discharge device without disassembling the discharge device, and the cleaning fluid is directly poured into them for cleaning.

For example, Patent Document 1 discloses a cleaning device for a functional droplet discharge head, which supplies a cleaning fluid to pass through a flow path in the head for cleaning of the flow path in the head, the device comprising a cleaning fluid tank that supplies the cleaning fluid, a cleaning fluid collection unit that recovers the cleaning fluid having passed through the flow path in the head, a cleaning fluid flow path through which the cleaning fluid is guided to flow from the cleaning fluid tank to the cleaning fluid collection unit through an introducing-portion connection joint and a cap, liquid feeding means that feeds the cleaning fluid through the cleaning fluid flow path, forced ventilation means that introduces air into the cleaning fluid flow path while forcedly supplying the air to pass therethrough, and control means that, after the end of the feeding of the cleaning fluid, drives the forced ventilation means to forcedly supply the air to pass through the cleaning fluid flow path.

Patent Document 2 discloses a nozzle cleaning device for a continuously-coating nozzle coater, featured in fabricating a cap that can accommodate a nozzle end portion of the nozzle coater including a nozzle, which has a slit-shaped nozzle opening formed at a nozzle tip for discharging a paint and to which a paint supply pipe is connected, the cap having a width wider than the nozzle opening, forming a paint drain hole in a region of the cap, which region is positioned to face the nozzle opening, and fixing a paint drain pipe to a portion of the paint drain hole, which portion is positioned outside the cap.

LIST OF PRIOR-ART DOCUMENTS

Patent Documents

Patent Document 1: Japanese Patent Laid-Open Publication No. 2005-58946

Patent Document 2: Japanese Utility Model Registration Laid-Open Publication No. H5-76563

SUMMARY OF THE INVENTION

Problems to be Solved by the Invention

The cleaning devices disclosed in the above-cited Patent Documents are premised on that the flow path as a cleaning target has a shape extending in one way from the liquid material supply side to the liquid material drain side, and that the cleaning fluid is supplied to flow through the flow path under a constant pressure. In a flow path having a complicated route configuration such as including a merging point and a branching point or being not uniform in sectional shape of the flow path, however, there is a problem that, due to a difference in flow resistance, streams in the merging and branching flow paths may partly stagnate or may flow backward in some cases.

Even when the discharge devices of the same type are used under the same conditions, an amount of the required cleaning fluid and a required cleaning time may be different depending on situation of the liquid material that remains in the flow path inside the liquid contact part. In order to ensure reliable cleaning, the cleaning conditions need to be set in consideration of the worst situation. This results in the problem that the cleaning fluid is wastefully consumed and productivity is reduced due to a longer cleaning time.

Furthermore, a high pressure is required to make the cleaning fluid pass through flow path inside the liquid contact part depending on the situation of the liquid material remaining in the flow path. Using the high pressure may cause deformation of the shape of the flow path or damage of the flow path. Such a problem is more significant particularly when the viscosity of the liquid material is high.

Accordingly, an object of the present invention is to provide a cleaning device and a cleaning method, which can solve the above-described problems.

Means for Solving the Problems

According to the present invention, there is provided a cleaning device for cleaning a liquid contact part of a discharge device that discharges a liquid material from a nozzle by action of a mechanically-operated rod-like member, the liquid contact part including an operating space into which the rod-like member is inserted, and a supply flow path through which the liquid material is supplied to the operating space, the cleaning device comprising a cleaning fluid supply tank that supplies a cleaning fluid by action of compressed gas supplied from a compressed gas source, a plurality of supply mechanisms that supply the compressed gas or the cleaning fluid, a liquid contact part fixing jig that is fluidly connected to the plural supply mechanisms, a cleaning fluid collection tank that is fluidly connected to the liquid contact part fixing jig, and a control device, wherein the supply mechanisms supply the cleaning fluid in accordance with pressure values that are specified separately for the supply mechanisms by the control device.

In the above-described cleaning device according to the present invention, the supply mechanisms may supply the compressed gas in accordance with pressure values that are specified separately for the supply mechanisms by the control device.

In the above-described cleaning device according to the present invention, the supply mechanism may comprise a regulator that adjusts pressure of the compressed gas, supplied from the compressed gas source, to a desired level in accordance with a pressure value specified by the control device, a first upstream on-off valve fluidly connected to the regulator, a second upstream on-off valve fluidly connected to the cleaning fluid supply tank, a sub-tank fluidly connected to the first and second upstream on-off valves and to the liquid contact part fixing jig, and a downstream on-off valve disposed between the sub-tank and the liquid contact part fixing jig.

In the above-described cleaning device according to the present invention, the compressed gas supplied from the compressed gas source may be supplied to the cleaning fluid supply tank through a plurality of regulators.

In the above-described cleaning device according to the present invention, the liquid contact part fixing jig may be constituted by a plurality of members that are fixed together by a fastener in a separable manner.

According to the present invention, there is also provided a cleaning method using the above-described cleaning device according to the present invention, the cleaning method comprising a gas cleaning step of supplying, by the supply mechanisms, the compressed gas under adjusted pressure to the liquid contact part fixing jig, a fluid cleaning step of supplying, by the supply mechanisms, the cleaning fluid to the liquid contact part fixing jig by action of the compressed gas under adjusted pressure, and a drying step of supplying, by the supply mechanisms, the compressed gas under adjusted pressure to the liquid contact part fixing jig.

According to the present invention, there is further provided a method of cleaning a liquid contact part of a discharge device that discharges a liquid material from a nozzle by action of a mechanically-operated rod-like member, the liquid contact part including an operating space into which the rod-like member is inserted, and a supply flow path through which the liquid material is supplied to the operating space, the method comprising a gas cleaning step of supplying the compressed gas under adjusted pressure to the liquid contact part fixing jig that accommodates the liquid contact part, a fluid cleaning step of supplying the cleaning fluid to the liquid contact part fixing jig by action of the compressed gas under the adjusted pressure, and a drying step of supplying the compressed gas under adjusted pressure to the liquid contact part fixing jig.

Advantageous Effects of the Invention

With the present invention, the liquid contact part of a flow path structure including a merging point and a branching point, can be cleaned with a uniform flow.

Furthermore, the cleaning fluid and/or the compressed air can be supplied in accordance with the pressure value separately specified for each supply mechanism.

In addition, with the present invention including the gas cleaning step, it is possible to realize reduction in an amount of the cleaning fluid used, a cleaning time, and the delivery pressure of the cleaning fluid.

MODE FOR CARRYING OUT THE INVENTION

The present invention provides a cleaning device for cleaning a liquid contact part of a discharge device of type discharging a liquid material from a nozzle by the action of a mechanically-operated rod-like member. The cleaning device of the present invention is able to solve the problem that, when the liquid contact part has a complicated flow path structure (particularly when the liquid contact part has a plurality of inlet ports and outlet ports in smaller number than the inlet ports), streams in flow paths inside the liquid contact part do not become uniform even with the cleaning fluid supplied under a constant pressure.

The cleaning device of the present invention includes supply mechanisms in the same number as the inlet ports of the liquid contact part. The supply mechanisms enable the cleaning fluid to be supplied under independently adjusted pressures. Each of the supply mechanisms includes a regulator, a first upstream on-off valve fluidly connected to the regulator, a second upstream on-off valve fluidly connected to a cleaning fluid supply tank, a sub-tank fluidly connected to the first and second upstream on-off valves and a liquid contact part fixing jig, and a downstream on-off valve disposed between the sub-tank and the liquid contact part fixing jig. Preferably, the number of delivery pipes (i.e., delivery flow paths in each of which the downstream on-off valve is disposed) connected to the liquid contact part fixing jig is set to be the same number of the outlet ports of the liquid contact part. An embodiment for carrying out the present invention will be described below.

<Liquid Contact Part>

Figure 4:
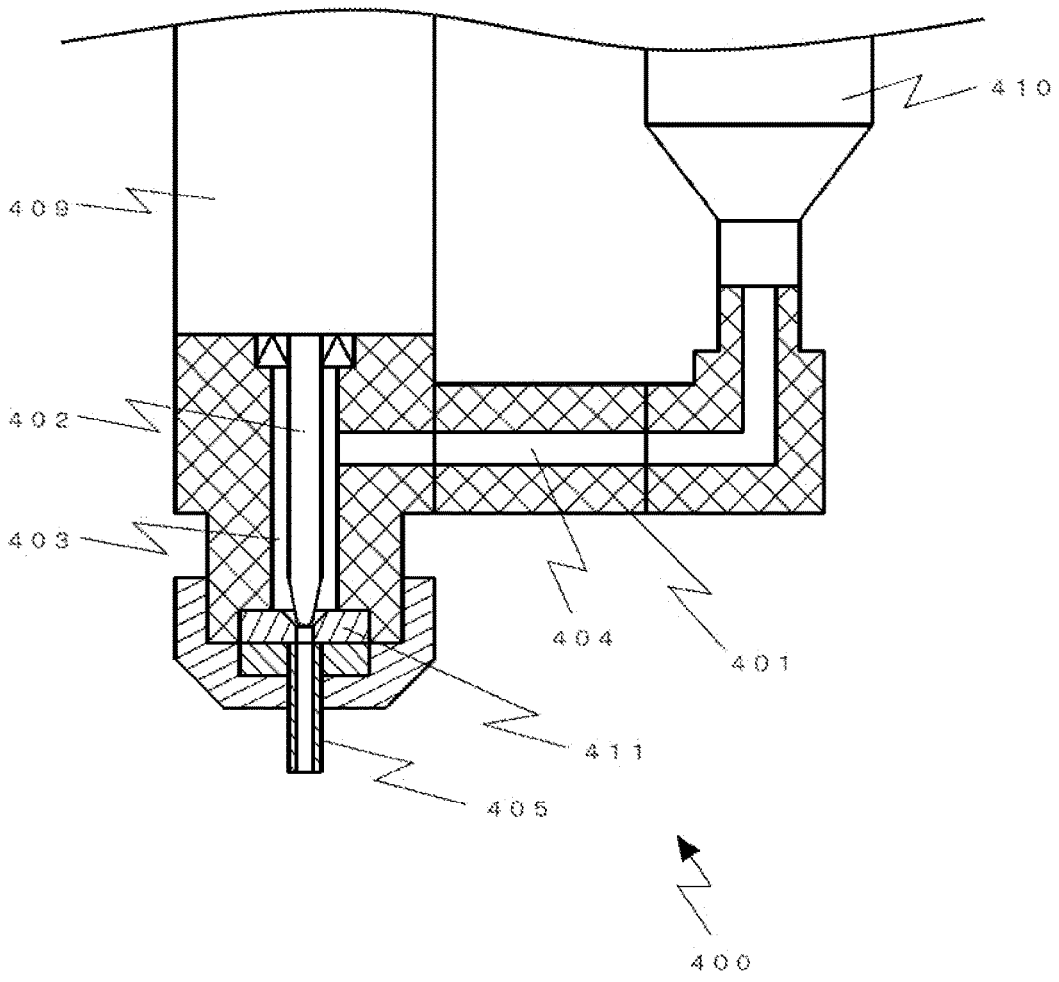
FIG. 4 is a partly-sectioned view to explain a jet type discharge device that is a cleaning target in the present invention.
Figure 5:
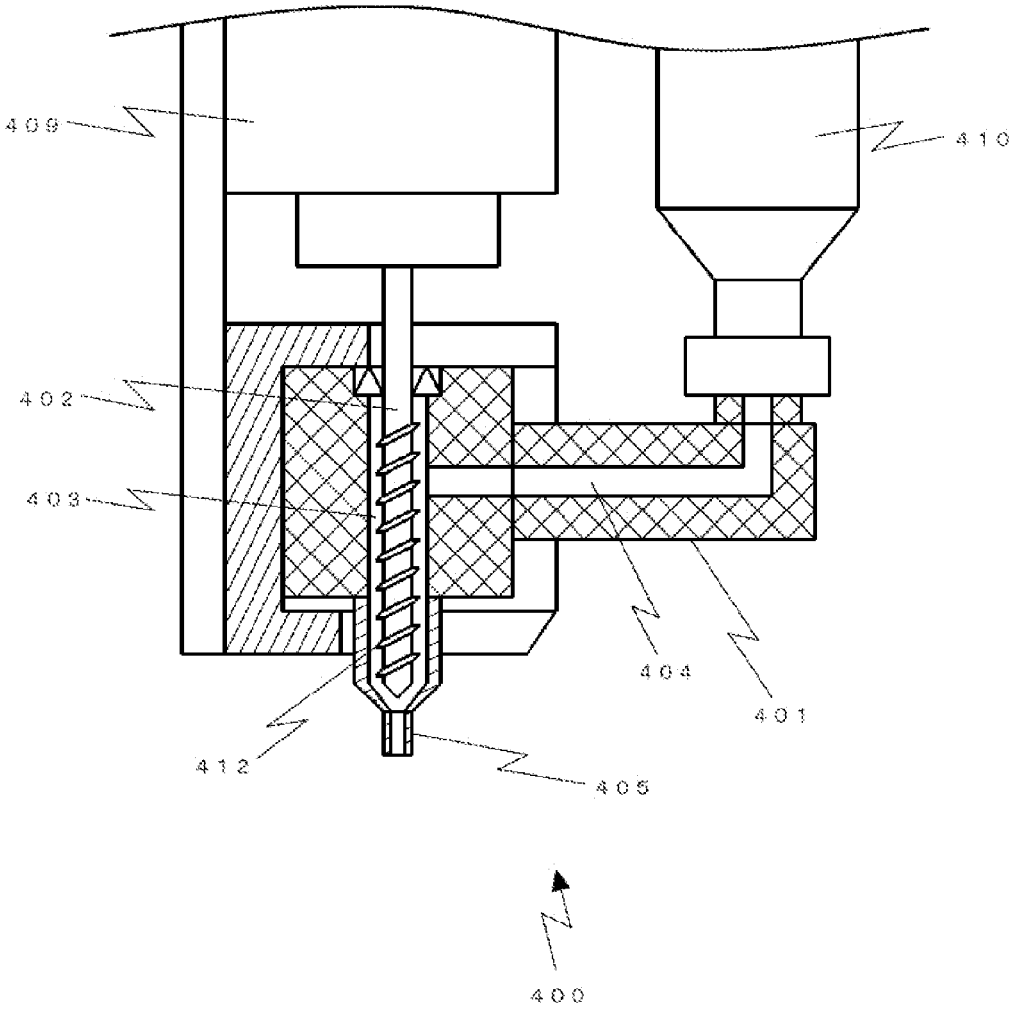
FIG. 5 is a partly-sectioned view to explain a screw type discharge device that is a cleaning target in the present invention.
Figure 6:
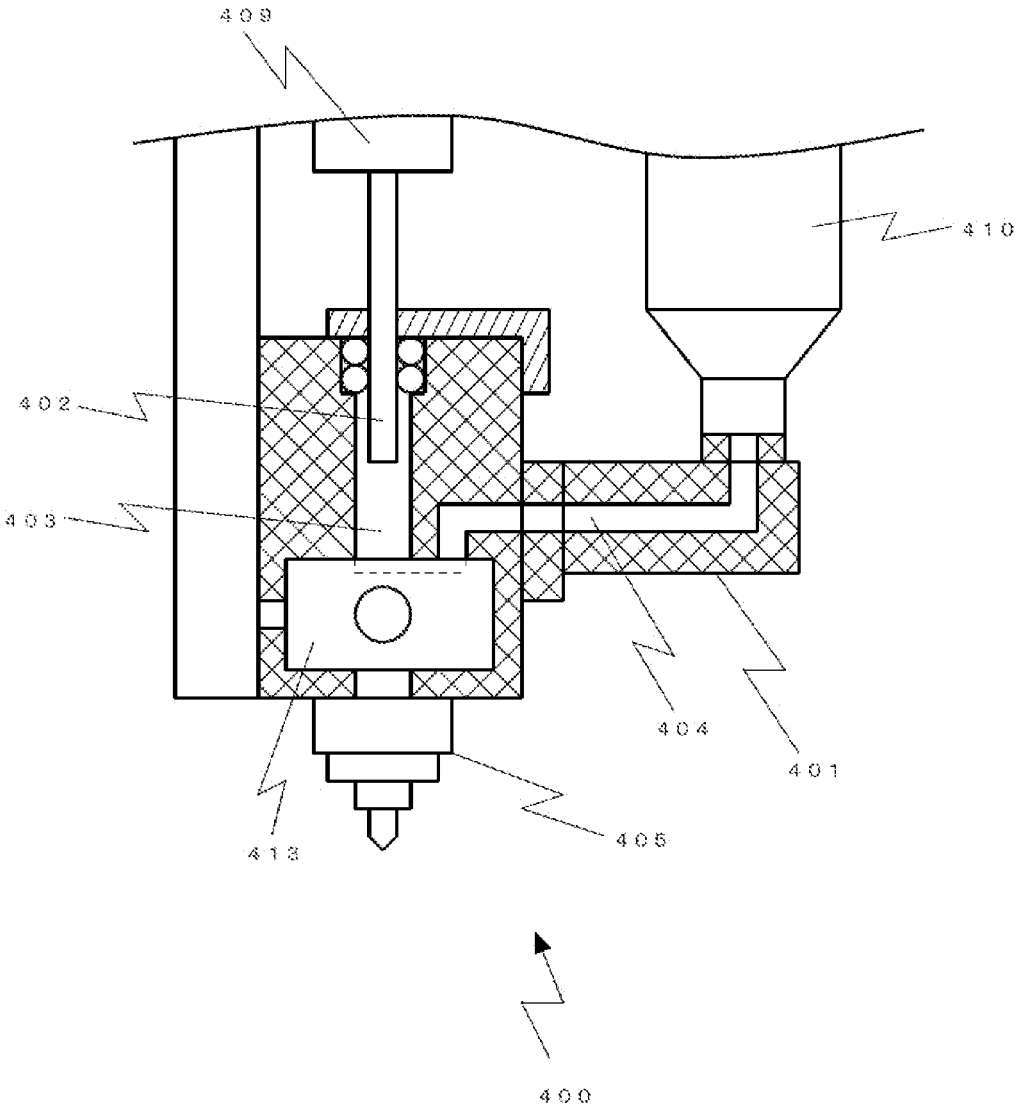
FIG. 6 is a partly-sectioned view to explain a plunger type discharge device that is a cleaning target in the present invention.

FIGS. 4 to 6 illustrate examples of a discharge device 400 including a liquid contact part that is to be cleaned by the cleaning device of the present invention. FIG. 4 illustrates a jet type discharge device in which a liquid material is discharged in the state of a droplet from a nozzle 405 by vertically moving a rod 402, which is a rod-like member, and by striking a tip of the rod against a valve seat 411. FIG. 5 illustrates a screw type discharge device in which the liquid material is discharged from the nozzle 405 by rotating a screw 402, which is a rod-like member and has a spiral flange 412, and by utilizing the action of the flange 412. FIG. 6 illustrates a plunger type discharge device in which the liquid material is discharged from the nozzle 405 by quickly moving and advancing a plunger 402, which is a rod-like member, and by abruptly stopping the plunger such that inertial force is given to the liquid material. At timing of discharge, a rotary valve 413 is rotated to establish communication between an operating space 403 where the rod-like member 402 is operated and the nozzle 405.

As illustrated in FIGS. 4 to 6, an inner flow path of the liquid contact part 401 in the above-mentioned type of the discharge device 400 has a structure that a flow path 404 through which the liquid material is to be supplied is connected directly or indirectly connected to the operating space 403 where the rod-like member 402 is operated. Stated in another way, the inner flow path has a merging and branching structure that the operating space 403 where the rod-like member 402 is operated and the flow path 404 through which the liquid material is to be supplied are merged together and are further communicated with the side including the nozzle 405. The flow path 404 generally has a hook-like shape or an L-shape when viewed from a side, but it has a shape linearly extending obliquely from a liquid material reservoir 410 in some cases.

When cleaning the liquid contact part 401 having the above-described structure, the cleaning is carried out after removing a drive unit 409 including the rod-like member 402, and the nozzle 405 disposed on the side opposite to the drive unit 409. The cleaning fluid is supplied to flow into the liquid contact part 401 through a connecting portion inlet A 406 connected to the liquid material reservoir 410 and through a connecting portion inlet B 407 into which the rod-like member 402 is inserted, and to flow out from the liquid contact part 401 through a connecting portion outlet 408 connected to the nozzle 405.

<Cleaning Device>

Figure 1:
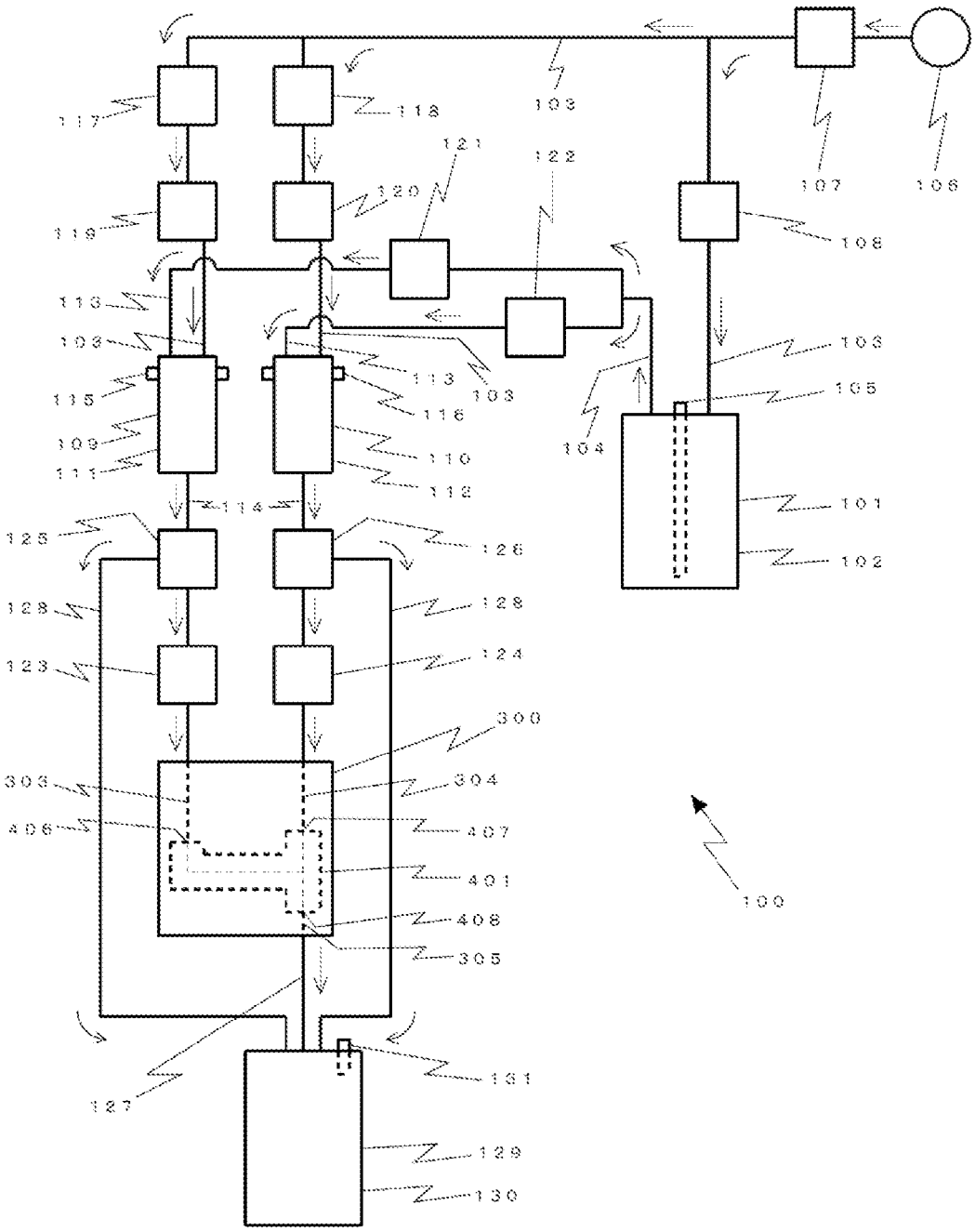
FIG. 1 is a schematic system diagram of a cleaning device according to an embodiment.

The constitution of the cleaning device according to the embodiment will be described below with reference to FIG. 1. FIG. 1 is a schematic system diagram of a cleaning device 100 according to the embodiment. An arrow in FIG. 1 denotes a direction in which gas and/or a liquid flows.

The cleaning device 100 according to the embodiment includes, as main components, a cleaning fluid supply tank 101, sub-tanks 109 and 110, a liquid contact part fixing jig 300, a cleaning fluid collection tank 129, and a control device (not illustrated). This embodiment includes two supply mechanisms. Each of the supply mechanisms includes a sub-tank (109, 110) that is connected to a pipe (denoted by, e.g., 104) in a liquid system and a pipe (denoted by, e.g., 103) in a gas system.

The cleaning fluid supply tank 101 includes a container body 102 that reserves the cleaning fluid, and a sensor A 105 that detects an amount of the cleaning fluid in the container body 102. Connected to the container body 102 are a gas pipe 103 through which compressed gas for delivering the cleaning fluid is supplied, and a fluid pipe 104 through which the cleaning fluid under pressure in the container body 102 is delivered. The fluid pipe 104 is branched corresponding to the number of the supply mechanisms (i.e., the number of the sub-tanks 109 and 110). In this embodiment, a liquid contact sensor is used as the sensor A 105. The liquid contact sensor makes detection by utilizing the fact that a resin-made detection portion will not reflect light upon contacting a liquid. As another example, a sensor for detecting a liquid surface by utilizing reflection of an ultrasonic wave can also be used. The capacity of the cleaning fluid supply tank 101 is preferably set to such a value that the cleaning fluid can be reserved in an amount corresponding to several cycles of the cleaning. This is intended to avoid the cleaning fluid from being exhausted during the operation when a fluid cleaning step is repeated or when the cleaning is performed in a continuous manner for a plurality of liquid contact parts 401, as described later.

The cleaning device 100 is connected to a compressed gas source 106 that supplies the compressed gas. The gas supplied from the compressed gas source 106 is branched after being adjusted to a desired pressure by a regulator A 107 such that one part is introduced to the two supply mechanisms and the other part is introduced to a regulator B 108. The regulator A 107 includes a mist separator and a filter. Thus, the regulator A 107 serves to bring the gas supplied from the compressed gas source 106 into a dried clean state, and to adjust the pressure of the gas in a way of suppressing pressure pulsation generated in the compressed gas source 106. The regulator B 108 adjusts the pressure under which the cleaning fluid is fed. By adjusting the pressure in two stages through the regulator A 107 and the regulator B 108, the compressed gas can be supplied to the cleaning fluid supply tank 101 in a state of the pressure pulsation being further suppressed.

In this embodiment, a regulator of type adjusting pressure by manually turning a thumbscrew is used as each of the regulator A 107 and the regulator B 108. However, the regulator is not limited to the above-mentioned type, and a later-described proportional control valve (electro-pneumatic regulator), which controls pressure in accordance with an electric signal, may be used instead. Furthermore, a gauge (pressure meter) is preferably disposed to be able to confirm a setting value.

The sub-tanks 109 and 110 include respectively container bodies 111 and 112 that temporarily reserve the cleaning fluid, and a sensor C 115 and a sensor D 116 that detect amounts of the cleaning fluid in the container bodies 111 and 112. Connected to each of the container bodies 111 and 112 are the gas pipe 103 through which the compressed gas is supplied, an inflow fluid pipe 113 through which the cleaning fluid flows, and a delivery pipe 114. In this embodiment, a transmissive type sensor is used as each of the sensor C 115 and the sensor D 116. The transmissive type sensor makes detection when light emitted from a light emitter to a light receiver is interrupted. As another example, a sensor for detecting a liquid surface by utilizing reflection of an ultrasonic wave can also be used. It is to be noted that the sub-tanks 109 and 110 are disposed in the same number as the number of later-described inlet ports of the liquid contact part 401.

The cleaning fluid supply tank 101 and the sub-tanks 109 and 110 are connected by pipes branched from the fluid pipe 104. An on-off valve C 121 and an on-off valve D 122 are disposed in the respective pipes branched from the fluid pipe 104 to control supply and stop of the cleaning fluid from the cleaning fluid supply tank 101. In this embodiment, a diaphragm valve is used as each of the on-off valve C 121 and the on-off valve D 122.

The compressed gas source 106 and the sub-tanks 109 and 110 are connected by pipes branched from the gas pipe 103. A pair of a regulator C 117 and an on-off valve A 119 and a pair of a regulator D 118 and an on-off valve B 120 are disposed in the respective pipes branched from the gas pipe 103 to not only adjust the compressed gas, which is under pressure adjusted by the regulator A 107, to a desired pressure, but also to control supply and stop of the compressed gas. As in the case of the above-described cleaning fluid supply tank 101, by adjusting the pressure in two stages through the regulator A 107 and each of the regulator C 117 and the regulator D 118, the compressed gas can be supplied to the sub-tanks 109 and 110 in a state of the pressure pulsation being further suppressed. In this embodiment, a proportional control valve (electro-pneumatic regulator), which controls pressure in accordance with an electric signal, is used as each of the regulator C 117 and the regulator D 118, and a solenoid valve is used as each of the on-off valve A 119 and the on-off valve B 120.

When the cleaning fluid is supplied to the liquid contact part fixing jig 300 (i.e., the liquid contact part 401), the cleaning fluid is first temporarily reserved in the sub-tanks 109 and 110 and then supplied to the liquid contact part 401 by the action of the compressed gas. Furthermore, when the compressed gas is supplied to the liquid contact part fixing jig 300 (i.e., the liquid contact part 401), the compressed gas is supplied to the liquid contact part 401 via the sub-tanks 109 and 110 that are in an empty state. Pressures of the compressed gas when supplying the cleaning fluid and the compressed gas to the liquid contact part fixing jig 300 are individually adjusted by the regulator C 117 and the regulator D 118, which are disposed respectively between the compressed gas source 106 and the sub-tanks 109 and 110.

Thus, according to this embodiment, with the provision of the sub-tanks 109 and 110, pressure adjustment can be performed by one common regulator (117 or 118) disposed per sub-tank without disposing a regulator in each of the fluid system (denoted by, e.g., 104) and the gas system (denoted by, e.g., 103). In addition, since the on-off valves (119 to 124) and the regulators (117 and 118) are disposed separately corresponding to the sub-tanks (109 and 110), the pressure can be controlled to different setting values (pressure values) that are different for each of the sub-tanks (109 and 110).

The liquid contact part fixing jig 300 is a jig for holding the liquid contact part 401 by two members (301 and 302) in a sandwiching manner. Connected to the liquid contact part fixing jig 300 are the delivery pipes 114 and 114 communicating respectively with the sub-tanks 109 and 110, and a drain pipe A 127 communicating with the cleaning fluid collection tank 129. The liquid contact part fixing jig 300 is detachably disposed in the cleaning device 100. Details of the liquid contact part fixing jig 300 will be described later.

An on-off valve E 123 is disposed between the sub-tank 109 and the liquid contact part fixing jig 300, and an on-off valve F 124 is disposed between the sub-tank 110 and the liquid contact part fixing jig 300, thereby controlling supply and stop of the cleaning fluid and the compressed gas. In this embodiment, a diaphragm valve is used as each of the on-off valve E 123 and the on-off valve F 124.

A switching valve A 125 is disposed between the sub-tank 109 and the on-off valve E 123, and a switching valve B 126 is disposed between the sub-tank 110 and the on-off valve F 124. The switching valve (125, 126) enables the cleaning fluid to be directly drained to the cleaning fluid collection tank 129 from the sub-tank (109, 110) without passing through the liquid contact part 401. In an ordinary mode, the switching valve (125, 126) communicates the sub-tank (109, 110) with the on-off valve (123, 124) between the sub-tank (109, 110) and the liquid contact part fixing jig 300. The switching valve (125, 126) is switched over in a drain mode. In this embodiment, a manually-operated switching valve is used as each of the switching valves A 125 and B 126.

The cleaning fluid collection tank 129 includes a container body 130 that stores the spent cleaning fluid, and a sensor B 131 that detects an amount of the spent cleaning fluid in the tank 129. Connected to the container body 130 are the drain pipe A 127 through which the fluid drained from the liquid contact part fixing jig 300 flows, and delivery pipes B 128 and 128 through which the fluids drained from the on-off valves A 125 and B 126 flow. The cleaning fluid collection tank 129 preferably has a capacity comparable to or more than that of the cleaning fluid supply tank 101. In this embodiment, a liquid contact sensor is used as the sensor B 131. The liquid contact sensor makes detection by utilizing the fact that a resin-made detection portion will not reflect light upon contacting a liquid. As another example, a sensor for detecting a liquid surface by utilizing reflection of an ultrasonic wave can also be used.

The control device (not illustrated) is constituted by an input unit, an output unit, a processing unit, and a memory unit. The control device is connected to the on-off valves A 119 to F 124, the regulators C 117 and D 118, and the sensors A 105 to D 116 to control them. For example, a keyboard or a mouse can be used as the input unit. For example, a monitor such as a liquid crystal display can be used as the output unit. Alternatively, a touch panel may be used for both the input unit and the output unit. For example, a personal computer or a programmable controller can be used as the processing unit and the memory unit.

<Liquid Contact Part Fixing Jig>

Figure 3:
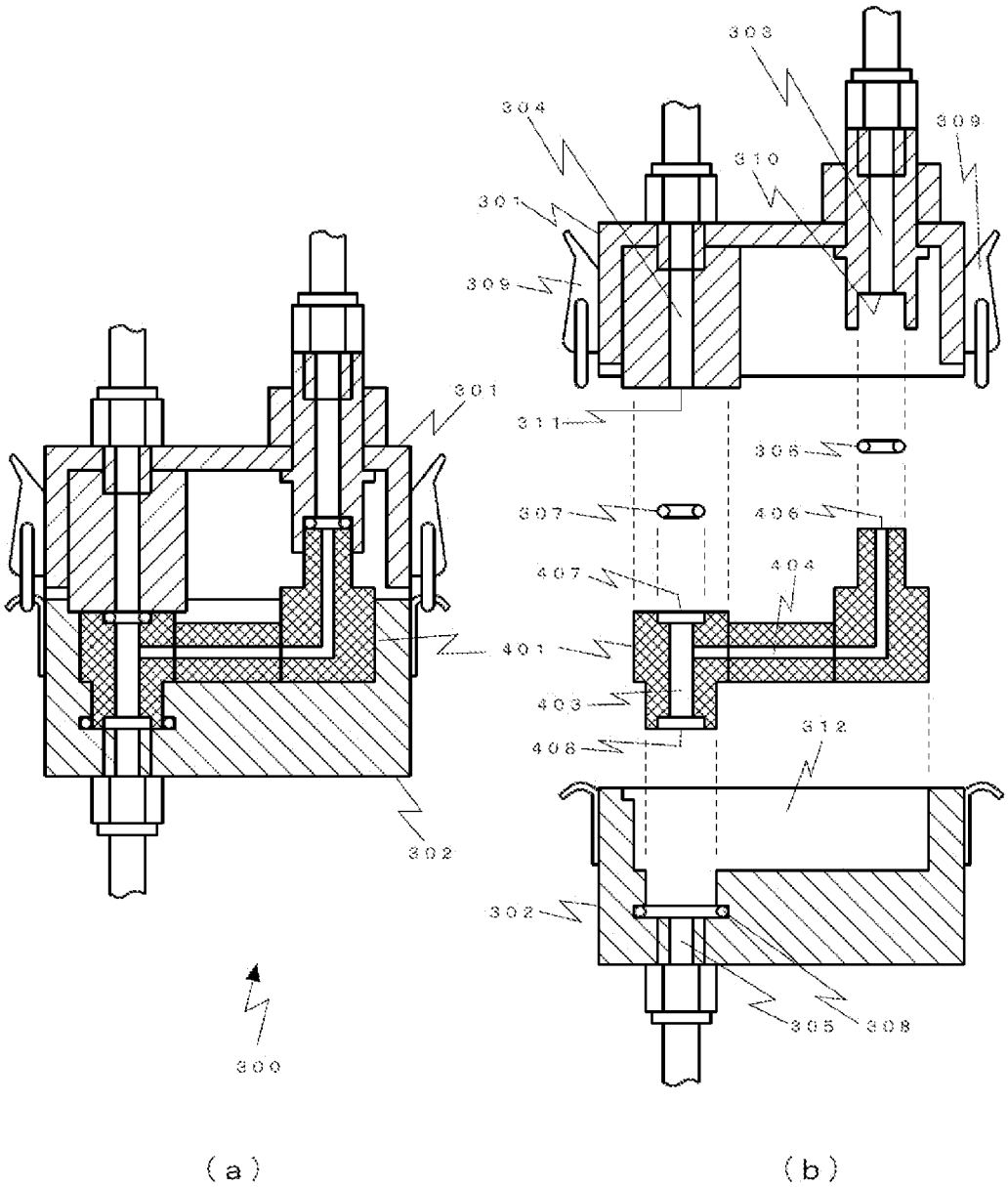
FIG. 3 is a sectional view to explain a liquid contact part fixing jig of the cleaning device according to the embodiment. More specifically, FIG. 3(*a*) illustrates an assembled state, and FIG. 3(*b*) illustrates a disassembled state.

Details of the liquid contact part fixing jig 300 will be described below with reference to FIG. 3. FIG. 3 is a sectional view to explain the liquid contact part fixing jig 300 of the cleaning device 100 according to the embodiment. More specifically, FIG. 3(*a*) illustrates an assembled state, and FIG. 3(*b*) illustrates a disassembled state. The liquid contact part 401 is, for example, one adapted for the jet type discharge device 400 illustrated in FIG. 4.

The liquid contact part fixing jig 300 is constituted by an inlet-side member 301 and an outlet-side member 302.

The inlet-side member 301 is provided with inlet pipes A 303 and B 304 for connecting respectively the connecting portion inlets A 406 and B 407 to the delivery pipes 114 and 114 of the sub-tanks 109 and 110. Respective ends of the inlet pipes 303 and 304 are formed in shapes adapted for communicating with the connecting portion inlets A 406 and B 407. A packing A 306 and a packing B 307 are disposed at joints between the inlet pipes and the connecting portion inlets to prevent leakage of the cleaning fluid and so on.

The outlet-side member 302 is provided with an outlet pipe 305 for connecting the connecting portion outlet 408 to the cleaning fluid collection tank 129. In the outlet-side member 302, a recess 312 is formed in a shape adapted for fitting with the liquid contact part 401. In this embodiment, the liquid contact part 401 is fitted in its half or more volume to the recess 312. The outlet pipe 305 is disposed at a lower end of the recess 312. An end of the outlet pipe 305 is formed in a shape adapted for communicating with the connecting portion outlet 408. A packing C 308 is disposed at a joint between the outlet pipe and the connecting portion outlet to prevent leakage of the cleaning fluid and so on.

The inlet-side member 301 and the outlet-side member 302 are preferably detachably fixed using a fastener. In this embodiment, a snap fastener 309 is disposed at each of two locations on lateral surfaces of the liquid contact part fixing jig 300 to fix the two members (301 and 302) in an easily detachable manner.

While one example of the liquid contact part fixing jig 300 has been described above, the inlet/outlet-side members (301 and 302) and the inlet/outlet pipes (303 to 305) are formed in match with the shape of the liquid contact part 401, which is different for each type of the discharge device, and they are not limited in shape and number to the illustrated ones. Moreover, the liquid contact part fixing jig 300 may fixedly hold the liquid contact part 401 from the right and left sides or both the lateral sides instead of fixedly holding if from the upper and lower sides as illustrated.

Thus, by forming the jig 300 in match with the outer shape of the liquid contact part 401, pipe connection can be facilitated when the liquid contact part 401 is cleaned. Another advantage is that the cleaning can be performed without disassembling the liquid contact part 401. Still another advantage is that, by preparing the jig 300 in several types in match with the shapes of different liquid contact parts 401, it is possible to facilitate the cleaning of the liquid contact parts 401 of different types of the discharge devices 400.

<Cleaning Operation>

Figure 2:
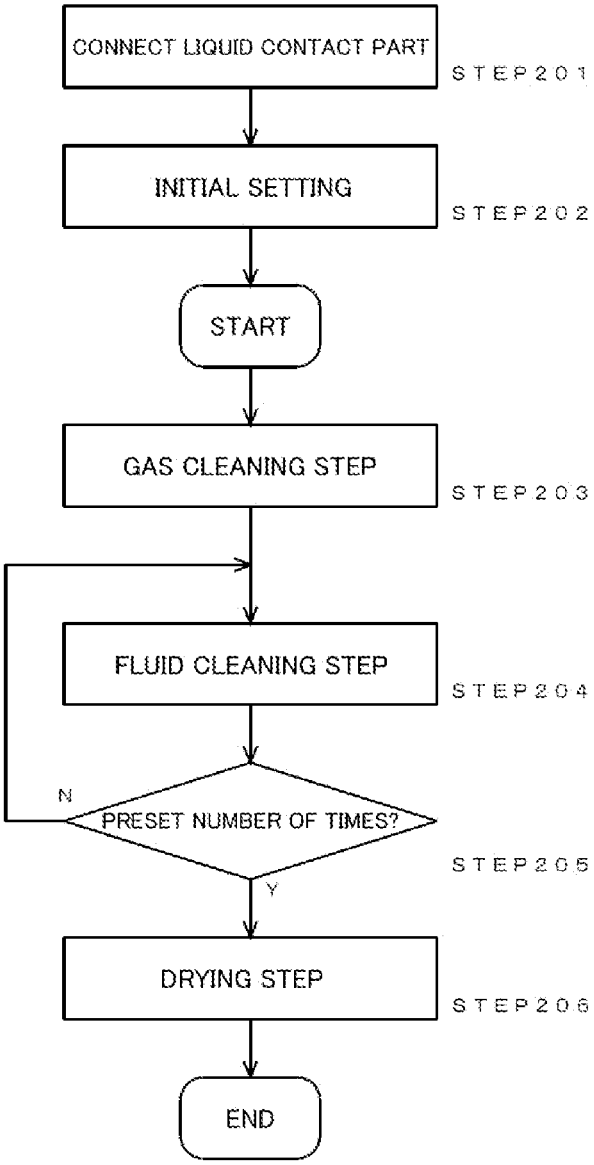
FIG. 2 is an operation flowchart of the cleaning device according to the embodiment.

The cleaning operation is carried out by the above-described cleaning device that operates as follows. FIG. 2 illustrates one example of an operation flowchart of the cleaning device.

(1) Connection of Liquid Contact Part (STEP 201)

The liquid contact part fixing jig 300 is mounted to the liquid contact part 401 that is to be cleaned, and the pipes (114 and 127) are connected to the liquid contact part fixing jig 300. It is assumed that the other devices and components are already installed and connected.

Furthermore, the cleaning fluid is poured into the cleaning fluid supply tank 101. The cleaning fluid collection tank 129 and the sub-tanks 109 and 110 are held in an empty state. In this embodiment, acetone is used as the cleaning fluid. However, the cleaning fluid is not limited to acetone, and it can be selected depending on properties of the liquid material. As another example, ethanol or isopropyl alcohol, which is usually employed as a solvent, can also be used.

(2) Initial Setting (STEP 202)

First, the pressures of the regulator A 107 and the regulator B 108 are set. In this embodiment, an operator adjusts the pressures by turning a thumbscrew while visually confirming the gauges.

Then, the pressures of the regulator C 117 and the regulator D 118 are set. In this embodiment, the pressures are set through the input unit of the control device. The settings of the regulators A to B are performed for each of later-described steps (gas cleaning, fluid cleaning, and drying). Setting values of the regulators C 117 and D 118 may be different or not different from each other depending on cases.

Then, on/off times of the on-off valves 119 to 124 (i.e., a cleaning time and a drying time), the amount of the cleaning fluid, and the number of times of repeating a fluid cleaning step are set through the input unit of the control device.

After the end of the above-described operation, the cleaning is started.

(3) Gas Cleaning Step (STEP 203)

Prior to supplying the cleaning fluid to the liquid contact part fixing jig 300, the compressed gas is supplied.

After opening the on-off valve E 123 and the on-off valve F 124 in the state where the on-off valve C 121 and the on-off valve D 122 are closed, the on-off valve A 119 and the on-off valve B 120 are opened. As a result, the compressed gas is supplied to the liquid contact part fixing jig 300 (i.e., the liquid contact part 401) through the regulator C 117→the on-off valve A 119→the sub-tank A 109→the switching valve A 125→the on-off valve E 123 and through the regulator D 118→the sub-tank B 110→the on-off valve B 120→the switching valve B 126→the on-off valve F 124. The compressed gas having passed through the liquid contact part fixing jig 300 is released to the atmosphere after reaching the cleaning fluid collection tank 129. After the lapse of the setting time, the on-off valve A 119 and the on-off valve B 120 are closed, and the on-off valve E 123 and the on-off valve F 124 are then closed.

The gas cleaning step has such an effect that holes are formed in the liquid material filling the flow paths (403 and 404) inside the liquid contact part 401, and that the liquid material adhering to inner walls of the flow paths is more apt to peel off from the flow path walls in a subsequent fluid cleaning step. This is because a contact area between the liquid material and the cleaning fluid is increased, whereby the action of the cleaning fluid dissolving the liquid material is promoted and a force-exerting range is enlarged.

Easier peeling-off of the liquid material from the flow path walls provides additional effects of cutting the amount of the cleaning fluid used, shortening the cleaning time, and reducing the delivery pressure of the cleaning fluid.

A pressure sensor may be disposed in the drain pipe A 127, and the on-off valves 119 to 124 may be controlled depending on change of pressure instead of waiting for the lapse of time. The reason is that pressure is changed upon holes being formed in the liquid material filling the flow paths (403 and 404) inside the liquid contact part 401.

(4) Fluid Cleaning Step (STEP 204)

The cleaning fluid is supplied to the liquid contact part fixing jig 300 (i.e., the liquid contact part 401). In detail, this step consists of the following two steps.

(4a) Supply of Cleaning Fluid to Sub-Tank (STEP 204*a*)

The on-off valve C 121 and the on-off valve D 122 are opened in the state where the on-off valve A 119, the on-off valve B 120, the on-off valve E 123, and the on-off valve F 124 are closed. As a result, the cleaning fluid is supplied from the cleaning fluid supply tank 101 to the sub-tanks 109 and 110 by the action of the compressed gas of which pressure has been adjusted by the regulator B 108. After the lapse of the setting time, the on-off valve C 121 and the on-off valve D 122 are closed.

Here, the amount of the cleaning fluid supplied is set to an amount used in one cycle of the cleaning. The supply of the cleaning fluid may be controlled depending on the results of detection by the sensor C 115 and the sensor D116 instead of using the setting time. In such a case, the volume of each sub-tank (109, 110) is preferably set to be substantially the same as that of the cleaning fluid required in one cycle of the cleaning.

(4b) Supply of Cleaning Fluid to Liquid Contact Part (STEP 204*b*)

After opening the on-off valve A 119 and the on-off valve B 120 in the state where the on-off valve C 121 and the on-off valve D 122 are closed, the on-off valve E 123 and the on-off valve F 124 are opened. As a result, the cleaning fluid in each of the sub-tanks 109 and 110 is pressurized by the compressed gas of which pressure has been adjusted by corresponding one of the regulators C 117 and D 118, and the cleaning fluid is supplied to the liquid contact part fixing jig 300 (i.e., the liquid contact part 401). After the lapse of the setting time, the on-off valve E 123 and the on-off valve F 124 are closed, and the on-off valve A 119 and the on-off valve B 120 are then closed.

Here, due attention is required because the sequence in opening and closing of the on-off valves at the start of supplying the cleaning fluid in this step is different from STEP 203. Such difference is attributable to the necessity of supplying the cleaning fluid in each of the sub-tanks 109 and 110 to the liquid contact part 401 after the cleaning fluid has been sufficiently pressurized by opening the on-off valve A 119 and the on-off valve B 120 at earlier timing.

As described above, there is the problem that, because the flow paths (403 and 404) inside the liquid contact part 401, i.e., the cleaning target in the present invention, has the merging and branching structure, the streams in the flow paths (403 and 404) will not become uniform even when the cleaning fluid is supplied to flow under a constant pressure. In the present invention, the problem is solved by disposing the supply mechanisms in the same number as that of the inlet ports of the liquid contact part 401. More specifically, the plural sub-tanks (109 and 110) are disposed, and the on-off valves (119 to 124) and the regulators (117 and 118) are separately disposed corresponding to each of the sub-tanks (109 and 110) such that the control to different setting values (pressure values) can be performed per sub-tank (109, 110). With the experiment conducted by the inventor, in the cleaning of the liquid contact part 401 of the jet type discharge device 400 illustrated in FIG. 4, the streams in the flow paths (403 and 404) inside the liquid contact part 401 were uniform when the regulator C 117 was set to 100 [kPa] and the regulator D 118 was set to 50 [kPa]. Such a result is presumably attributable to the fact that, since the flow path (supply flow path) including the connecting portion inlet A 406 has a smaller diameter and a longer distance than the flow path (operating space) including the connecting portion inlet B 407, whereby flow resistance is increased and a higher pressure is required for the connecting portion inlet A 406.

In the above-mentioned experiment, the setting values of the regulator C 117 and the regulator D 118 in STEP 203 and STEP 206 were both set to 200 [kPa].

(5) Determination (STEP 205)

If the number of times of the fluid cleaning step (STEP 204) already carried out does not yet reach the setting number of times set in STEP 202, the control flow is returned to STEP 204 to execute the fluid cleaning step again. If the number of times of the fluid cleaning step already carried out reaches the setting number of times, the control flow advances to a next step, i.e., "Drying Step (STEP 206)".

(6) Drying Step (STEP 206)

The compressed gas is supplied to completely remove the cleaning fluid from the flow paths (403 and 404) inside the liquid contact part 401.

After opening the on-off valve E 123 and the on-off valve F 124 in the state where the on-off valve C 121 and the on-off valve D 122 are closed, the on-off valve A 119 and the on-off valve B 120 are opened. As a result, the compressed gas is supplied to the liquid contact part fixing jig 300 (i.e., the liquid contact part 401) through the regulator C 117→the on-off valve A 119→the sub-tank A 109→the switching valve A 125→the on-off valve E 123 and through the regulator D 118→the sub-tank B 110→the switching valve B 126→the on-off valve F 124. The compressed gas having passed through the liquid contact part fixing jig 300 is released to the atmosphere after reaching the cleaning fluid collection tank 129. After the lapse of the setting time, the on-off valve A 119 and the on-off valve B 120 are closed, and the on-off valve E 123 and the on-off valve F 124 are then closed.

The cleaning operation is thus ended.

The processes executed in STEPs 203 to 205 can be automated by storing the values, which have been set in STEP 202, in the memory unit of the control device. This enables the cleaning operation to be efficiently performed in the case that there are many liquid contact parts 401 for which the cleaning is to be carried out, and that the same operation has to be repeated.

LIST OF REFERENCE SYMBOLS

100: cleaning device 101: cleaning fluid supply tank 102: container body (for supply) 103: gas pipe 104: fluid pipe 105: sensor A 106: compressed gas source 107: regulator A 108: regulator B 109: sub-tank A 110: sub-tank B 111: container body (sub A) 112: container body (sub B) 113: inflow fluid pipe 114: drain pipe 115: sensor C 116: sensor D 117: regulator C 118: regulator D 119: on-off valve A 120: on-off valve B 121: on-off valve C 122: on-off valve D 123: on-off valve E 124: on-off valve F 125: switching valve A 126: switching valve B 127: drain pipe A 128: drain pipe B 129: cleaning fluid collection tank 130: container body (for collection) 131: sensor B 300: liquid contact part fixing jig 301: inlet-side member 302: outlet-side member 303: inlet pipe A 304: inlet pipe B 305: outlet pipe 306: packing A 307: packing B 308: packing C 309: snap fastener 310: inlet pipe end A 311: inlet pipe end B 312: recess 400: discharge device 401: liquid contact part 402: rod-like member 403: operating space (flow path A) 404: liquid material supply flow path (flow path B) 405: nozzle 406: connecting portion inlet A 407: connecting portion inlet B 408: connecting portion outlet 409: drive unit 410: liquid material reservoir 411: valve seat 412: spiral flange 413: rotary valve

The invention claimed is:

1. A cleaning device for cleaning a liquid contact part of a discharge device that discharges a liquid material from a nozzle by action of a mechanically-operated rod member, the liquid contact part including an operating space into which the rod member is inserted, and a supply flow path through which the liquid material is supplied to the operating space, the cleaning device comprising:

a cleaning fluid supply tank that supplies a cleaning fluid to a plurality of supply mechanisms by action of compressed gas supplied from a compressed gas source;

a liquid contact part fixing jig that is connected to the plurality of the supply mechanisms;

the plurality of supply mechanisms that supply the cleaning fluid to the liquid contact part fixing jig;

a cleaning fluid collection tank that is connected to the liquid contact part fixing jig; and a controller configured to control pressure value of the cleaning fluid supplied from each of the supply mechanisms independently from other of the supply mechanisms.

2. The cleaning device according to claim 1, wherein the supply mechanisms supply the compressed gas in accordance with pressure values that are specified independently from other of the supply mechanisms by the controller.

3. The cleaning device according to claim 2, wherein at least one of the supply mechanisms comprises:

a regulator that adjusts pressure of the compressed gas, supplied from the compressed gas source, to a desired level in accordance with a pressure value specified by the controller;

a first upstream on-off valve connected to the regulator;

a second upstream on-off valve connected to the cleaning fluid supply tank;

a sub-tank connected to the first and second upstream on-off valves and to the liquid contact part fixing jig; and a downstream on-off valve disposed between the sub-tank and the liquid contact part fixing jig.

4. The cleaning device according to claim 2, wherein the compressed gas supplied from the compressed gas source is supplied to the cleaning fluid supply tank through a plurality of regulators.

5. The cleaning device according to claim 2, wherein the liquid contact part fixing jig is constituted by a plurality of members that are fixed together by a fastener in a separable manner.

6. The cleaning device according to claim 1, wherein at least two of the supply mechanisms comprises:

a regulator that adjusts pressure of the compressed gas, supplied from the compressed gas source, to a desired level in accordance with a pressure value specified by the controller;

a first upstream on-off valve connected to the regulator;

a second upstream on-off valve connected to the cleaning fluid supply tank;

a sub-tank connected to the first and second upstream on-off valves and to the liquid contact part fixing jig; and a downstream on-off valve disposed between the sub-tank and the liquid contact part fixing jig.

7. The cleaning device according to claim 6, wherein the compressed gas supplied from the compressed gas source is supplied to the cleaning fluid supply tank through a plurality of regulators.

8. The cleaning device according to claim 6, wherein the liquid contact part fixing jig is constituted by a plurality of members that are fixed together by a fastener in a separable manner.

9. The cleaning device according to claim 1, wherein the compressed gas supplied from the compressed gas source is supplied to the cleaning fluid supply tank through a plurality of regulators.

10. The cleaning device according to claim 9, wherein the liquid contact part fixing jig is constituted by a plurality of members that are fixed together by a fastener in a separable manner.

11. The cleaning device according to claim 1, wherein the liquid contact part fixing jig is constituted by a plurality of members that are fixed together by a fastener in a separable manner.

12. A cleaning method using the cleaning device according to claim 1, the cleaning method comprising:

a gas cleaning step of supplying, by the supply mechanisms, the compressed gas under adjusted pressure to the liquid contact part fixing jig;

a fluid cleaning step of supplying, by the supply mechanisms, the cleaning fluid to the liquid contact part fixing jig by action of the compressed gas under adjusted pressure; and a drying step of supplying, by the supply mechanisms, the compressed gas under adjusted pressure to the liquid contact part fixing jig.

13. A method of cleaning a liquid contact part of a discharge device that discharges a liquid material from a nozzle by action of a mechanically-operated rod member, the liquid contact part including an operating space into which the rod member is inserted, and a supply flow path through which the liquid material is supplied to the operating space, the method comprising:

a gas cleaning step of supplying the compressed gas under adjusted pressure to the liquid contact part fixing jig that accommodates the liquid contact part;

a fluid cleaning step of supplying the cleaning fluid to the liquid contact part fixing jig by action of the compressed gas under the adjusted pressure; and a drying step of supplying the compressed gas under adjusted pressure to the liquid contact part fixing jig.

14. A cleaning method using the cleaning device according to claim 2, the cleaning method comprising:

a gas cleaning step of supplying, by the supply mechanisms, the compressed gas under adjusted pressure to the liquid contact part fixing jig;

a fluid cleaning step of supplying, by the supply mechanisms, the cleaning fluid to the liquid contact part fixing jig by action of the compressed gas under adjusted pressure; and a drying step of supplying, by the supply mechanisms, the compressed gas under adjusted pressure to the liquid contact part fixing jig.

15. A cleaning method using the cleaning device according to claim 6, the cleaning method comprising:

a gas cleaning step of supplying, by the supply mechanisms, the compressed gas under adjusted pressure to the liquid contact part fixing jig;

a fluid cleaning step of supplying, by the supply mechanisms, the cleaning fluid to the liquid contact part fixing jig by action of the compressed gas under adjusted pressure; and a drying step of supplying, by the supply mechanisms, the compressed gas under adjusted pressure to the liquid contact part fixing jig.

16. A cleaning method using the cleaning device according to claim 9, the cleaning method comprising:

a gas cleaning step of supplying, by the supply mechanisms, the compressed gas under adjusted pressure to the liquid contact part fixing jig;

a fluid cleaning step of supplying, by the supply mechanisms, the cleaning fluid to the liquid contact part fixing jig by action of the compressed gas under adjusted pressure; and a drying step of supplying, by the supply mechanisms, the compressed gas under adjusted pressure to the liquid contact part fixing jig.

17. A cleaning method using the cleaning device according to claim 11, the cleaning method comprising:

a gas cleaning step of supplying, by the supply mechanisms, the compressed gas under adjusted pressure to the liquid contact part fixing jig;

a fluid cleaning step of supplying, by the supply mechanisms, the cleaning fluid to the liquid contact part fixing jig by action of the compressed gas under adjusted pressure; and a drying step of supplying, by the supply mechanisms, the compressed gas under adjusted pressure to the liquid contact part fixing jig.

18. A cleaning device for cleaning a liquid contact part of a discharge device that discharges a liquid material from a nozzle by action of a mechanically-operated rod member, the liquid contact part including an operating space having an inlet A into which the rod member is inserted and an outlet which communicates with the nozzle, a supply flow path through which the liquid material is supplied to the operating space, and an inlet B provided on an end of the supply flow path, the nozzle and the rod member are detachably connected to the liquid contact part, the cleaning device comprising:

a cleaning fluid supply tank that supplies a cleaning fluid to a plurality of supply mechanisms by action of compressed gas supplied from a compressed gas source;

a liquid contact part fixing jig that accommodates the liquid contact part;

the plurality of supply mechanisms that supply the cleaning fluid to the liquid contact part fixing jig;

a cleaning fluid collection tank that is connected to the liquid contact part fixing jig and collects the cleaning fluid supplied from the outlet; and a controller, wherein the plurality of supply mechanisms includes a first supply mechanism that supplies the cleaning fluid to the inlet A and a second supply mechanism that supplies the cleaning fluid to the inlet B, and wherein the each of supply mechanisms supply the cleaning fluid in accordance with pressure values that are specified independently from other of the supply mechanisms by the controller.

19. A cleaning method using the cleaning device according to claim 18, the cleaning method comprising:

a gas cleaning step of supplying, by the first supply mechanism and the second supply mechanism, the compressed gas under adjusted pressure to the liquid contact part fixing jig;

a fluid cleaning step of supplying, by the first supply mechanism and the second supply mechanism, the cleaning fluid to the liquid contact part fixing jig by action of the compressed gas under adjusted pressure, the adjusted pressure adjusted to the pressure value that are specified independently from other of supply mechanism; and a drying step of supplying, by the first supply mechanism and the second supply mechanism, the compressed gas under adjusted pressure to the liquid contact part fixing jig.

20. A method of cleaning a liquid contact part of a discharge device that discharges a liquid material from a nozzle by action of a mechanically-operated rod member, wherein the liquid contact part fixing jig is accommodated in a liquid contact part fixing jig, the liquid contact part including an operating space having an inlet A into which the rod member is inserted and an outlet which communicates with the nozzle, a supply flow path through which the liquid material is supplied to the operating space, and an inlet B provided on an end of the supply flow path, the nozzle and the rod member are detachably connected to the liquid contact part, the method comprising:

a gas cleaning step of supplying the compressed gas under adjusted pressure to the liquid contact part fixing jig from a first supply mechanism which communicates with the inlet A and a second supply mechanism which communicates with the inlet B;

a fluid cleaning step of supplying the cleaning fluid from the first supply mechanism and the second supply mechanism by action of the compressed gas supplied under the adjusted pressure, the adjusted pressure adjusted to the pressure values that are specified independently from other of supply mechanisms; and a drying step of supplying the compressed gas under adjusted pressure to the inlet A and the inlet B.

* * * * *